US007026589B2

(12) United States Patent
Kim

(10) Patent No.: US 7,026,589 B2
(45) Date of Patent: Apr. 11, 2006

(54) MICROWAVE OVEN

(75) Inventor: Sung Kwang Kim, Ansan-Si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 0 days.

(21) Appl. No.: 11/060,555

(22) Filed: Feb. 18, 2005

(65) Prior Publication Data

US 2005/0184063 A1 Aug. 25, 2005

(30) Foreign Application Priority Data

Feb. 20, 2004 (KR) ..... 10-2004-0011406

(51) Int. Cl.
*H05B 6/66* (2006.01)

(52) U.S. Cl. ..... 219/702

(58) Field of Classification Search ..... 219/702, 219/428, 663, 625, 779
See application file for complete search history.

(56) References Cited

U.S. PATENT DOCUMENTS

| | | | | |
|---|---|---|---|---|
| 3,302,060 | A * | 1/1967 | Blok et al. | 315/307 |
| 4,056,699 | A * | 11/1977 | Jordan | 200/5 A |
| 5,132,501 | A * | 7/1992 | Green | 219/732 |
| 5,235,150 | A * | 8/1993 | Buske et al. | 219/722 |
| 5,317,134 | A * | 5/1994 | Edamura | 219/720 |
| 6,150,645 | A * | 11/2000 | Lewis et al. | 219/715 |
| 6,265,984 | B1 * | 7/2001 | Molinaroli | 340/815.4 |
| 6,350,973 | B1 * | 2/2002 | Wroe et al. | 219/680 |
| 6,906,298 | B1 * | 6/2005 | Han et al. | 219/702 |
| 6,943,321 | B1 * | 9/2005 | Carbone et al. | 219/400 |

FOREIGN PATENT DOCUMENTS

| | | | |
|---|---|---|---|
| JP | 62-040857 | A | 2/1987 |
| JP | 3-267623 | A | 11/1991 |
| JP | 4-75290 | A | 3/1992 |
| JP | 10-169994 | A | 6/1998 |
| KR | 2002-0040987 | A | 5/2002 |

* cited by examiner

*Primary Examiner*—Daniel Robinson
(74) *Attorney, Agent, or Firm*—Sughrue Mion, PLLC

(57) ABSTRACT

A microwave oven with a control panel including a case, a circuit board mounted to the case, and a coupling device adapted to couple the case and the circuit board. The coupling device includes a plurality of coupling members protruded from an inner surface of the case. Each of the coupling members has an engagement protrusion at a protruded end thereof. The coupling device also includes a plurality of engagement holes provided at the circuit board at positions corresponding to respective coupling members so that the engagement holes are engaged with the engagement protrusions of the coupling members, respectively. Accordingly, it is possible to mount the circuit board to a rear side of the case in the interior of the case without using fixing screws, in accordance with a single-pass mounting process, thereby achieving an enhancement in the productivity of circuit boards and a reduction in manufacturing costs.

19 Claims, 6 Drawing Sheets

MICROWAVE OVEN

CROSS-REFERENCE TO RELATED APPLICATION

This application is based upon and claims the benefit of priority from Korean Patent Application No. 2004-11406, filed on Feb. 20, 2004 in the Korean Intellectual Property Office, the disclosure of which is incorporated herein in its entirety by reference.

BACKGROUND OF THE INVENTION

1. Field of the Invention

The invention relates to a microwave oven, and, more particularly, to a microwave oven in which a control panel thereof has an improved circuit board mounting structure.

2. Description of the Related Art

Generally, a microwave oven is a cooking appliance adapted to cook food using microwaves. Such a microwave oven includes a cooking chamber, in which food is cooked, and an electric element chamber for receiving various electric elements adapted to supply microwaves into the cooking chamber. The microwave oven also includes a control panel adapted to control operation of the microwave oven, and to display an operating state of the microwave oven. Typically, the control panel is arranged in front of the electric element chamber.

The control panel includes a case having a size capable of covering an opening formed at a front end of the electric element chamber. The case is provided with, on an outer surface of a front wall thereof, a plurality of control buttons and a display (LCD). A circuit board is mounted to a rear end of the case, and is provided with a circuit operatively connected to the control buttons to control operation of the microwave oven. The circuit board is fixed to the case by means of a plurality of fixing screws while being supported by a plurality of support ribs provided at the rear end of the case to be spaced apart from an inner surface of the front wall of the case.

However, such a microwave oven has various problems in that the mounting of the circuit board to the case is achieved using a plurality of fixing screws each requiring a fastening process. For example, there is an increase in manufacturing costs and a degradation in assemble-ability and productivity in the manufacture of control panels caused by an increased number of screw fastening processes.

SUMMARY OF THE INVENTION

Therefore, an aspect of the invention is to provide a microwave oven in which a circuit board can be mounted to a rear end of a case without using fixing screws, in accordance with a single-pass mounting process, thereby achieving an enhancement in the productivity of control panels and a reduction in manufacturing costs.

The above and/or other aspects are achieved by providing a microwave oven control panel comprising a case, a circuit board and a coupling device coupling the case and the circuit board, wherein the coupling device comprises: a coupling member, protruding from an inner surface of the case, comprising an engagement protrusion at a distal end thereof; and an engagement hole provided in the circuit board, engaged with the engagement protrusion of the coupling member.

The engagement between the engagement protrusion of the coupling member and the engagement hole may be achieved in accordance with an insertion of the engagement protrusion into the engagement hole, and a subsequent movement of the circuit board in a direction orthogonal to that of the insertion of the engagement protrusion.

The engagement protrusion may comprise a neck having a first cross-sectional area, and a head formed at a distal end of the neck having a second cross-sectional area larger than the first cross sectional area. The engagement hole may comprise an entrance portion having a size allowing the head of the engagement protrusion to pass therethrough, and an engagement portion formed at one side of the entrance portion having a width corresponding to that of the neck of the engagement protrusion to allow the neck to be inserted therein and to be engaged therewith.

The coupling device may further comprise a locking hook protruding from the case, and a locking hole provided in the circuit board to engage with the locking hook, whereby movement of the circuit board in a direction orthogonal to the insertion direction is restricted under a condition in which the coupling member and the engagement hole are in an engaged state.

The locking hook may be elastically deformable at a portion engageable with the locking hole.

The engagement protrusion may have a groove adapted to be engaged with a portion of the circuit board corresponding to one side of the engagement hole when subsequent movement of the circuit board is carried out.

Further, a plurality of engagement protrusions and engagement holes may be provided, the one side of the engagement hole where the engagement portion is formed may be a side furthest away from the locking hole, the case may be concave and surround the perimeter of the circuit board, the circuit board may be planar, the engagement hole may be T-shaped, the engagement protrusion may be T-shaped in cross-section, and the locking hook may protrude inwardly from a peripheral surface of the case.

BRIEF DESCRIPTION OF THE DRAWINGS

The above and other objects, features and advantages of the invention will become more apparent after reading the following detailed description when taken in conjunction with the drawings, in which.

DETAILED DESCRIPTION OF THE EXEMPLARY EMBODIMENTS

Exemplary embodiments of the invention will now be described in detail with reference to the annexed drawings. The described exemplary embodiments are intended to assist the understanding of the invention, and are not intended to limit the scope of the invention in any way.

Figure 1:
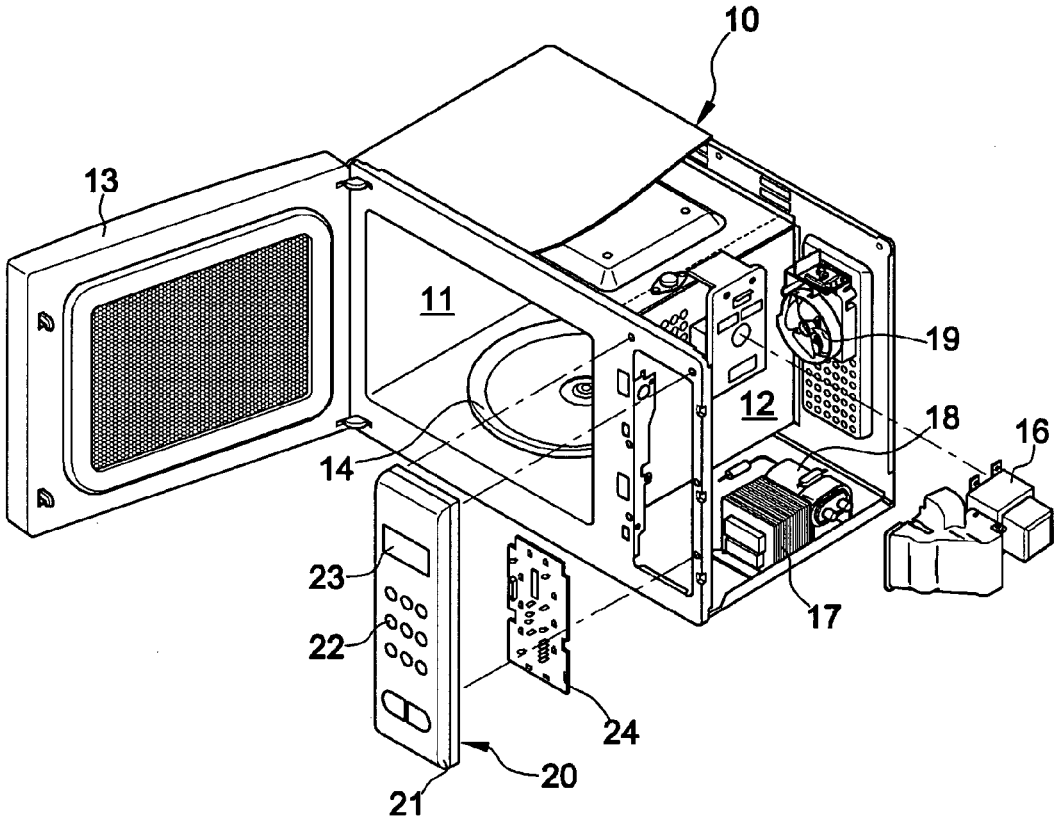
FIG. 1 is an exploded perspective view illustrating a configuration of a microwave oven according to the invention.

Referring to FIG. 1, a microwave oven according to an exemplary embodiment of the invention is illustrated. As shown in FIG. 1, the microwave oven includes an oven body 10 partitioned into a cooking chamber 11 for cooking food therein, and an electric element chamber 12 for receiving various electric elements therein. The cooking chamber 11 is opened at a front end thereof to receive food therein through the opened front end. A door 13 is mounted to the opened front end of the cooking chamber 11 to open and close the cooking chamber 11. A tray 14 is rotatably installed in the cooking chamber 11 to allow food to be laid thereon.

The electric element chamber 12 receives therein various electric elements, for example, a magnetron 16 for supplying microwaves into the cooking chamber 11, a high-voltage transformer 17 and a high-voltage condenser 18 for supplying high voltage to the magnetron 16, and a circulation fan 19 for cooling the electric element chamber 12. A control panel 20 is mounted to the oven body 10 in front of the electric element chamber 12 to control operation of the microwave oven in accordance with an operation carried out by the user.

Figure 2:
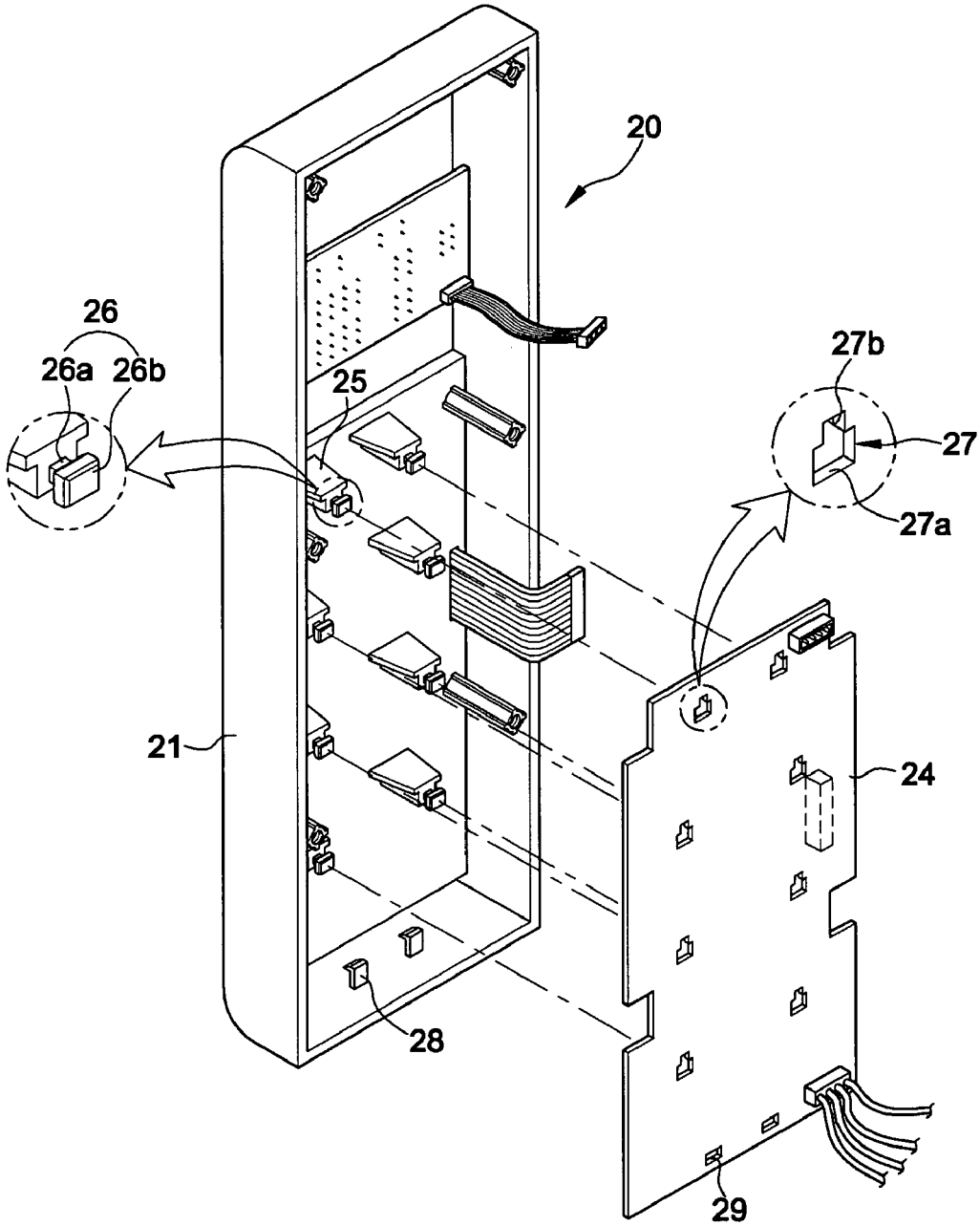
FIG. 2 is a perspective view of a configuration of a control panel included in the microwave oven according to the invention, illustrating a state in which a circuit board is separated from a case.

As shown in FIGS. 1 and 2, the control panel 20 includes a case 21 having a size corresponding to the front end of the electric element chamber 12, and a circuit board 24 mounted in the interior of the case 21. The case 21 is provided, at a lower portion thereof, with a plurality of control buttons 22 to control operation of the microwave oven, while being provided, at an upper portion thereof, with a display 23 to display an operating state of the microwave oven.

The circuit board 24 is mounted to the case 21 such that it is rearwardly spaced apart from an inner surface of a front wall of the case 21. For such a mounting condition of the circuit board 24, a plurality of coupling members 25 are provided at the inner surface of the front wall of the case 21. Each coupling member 25 is rearwardly protruded from the inner surface of the front wall of the case 21 by a desired length, and has an engagement protrusion 26 at a protruded end thereof. Also, a plurality of engagement holes 27 are provided at the circuit board 24 at positions corresponding to respective coupling members 25 so that they are engaged with the engagement protrusions 26 of the coupling members 25, respectively.

Figure 3:
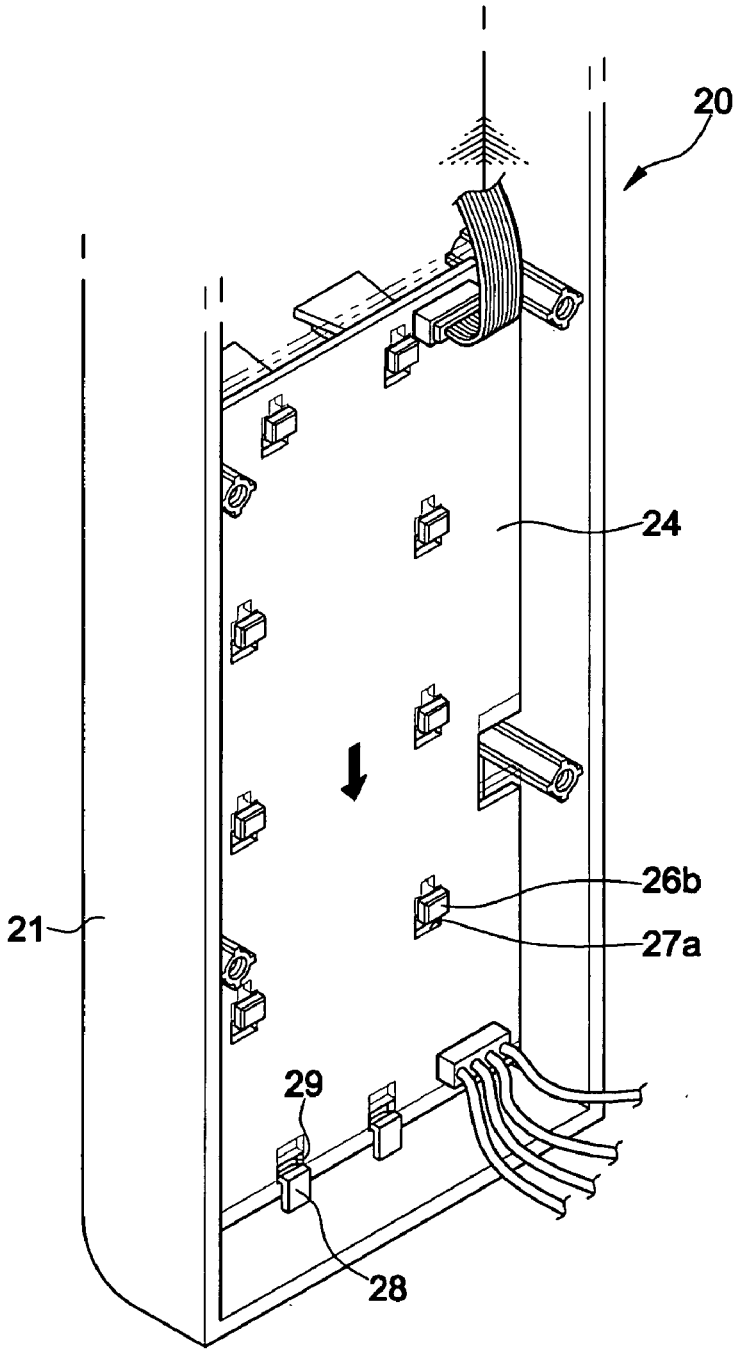
FIG. 3 is a perspective view of the configuration of the control panel, illustrating a state in which the circuit board is mounted in the interior of the case.
Figure 4:
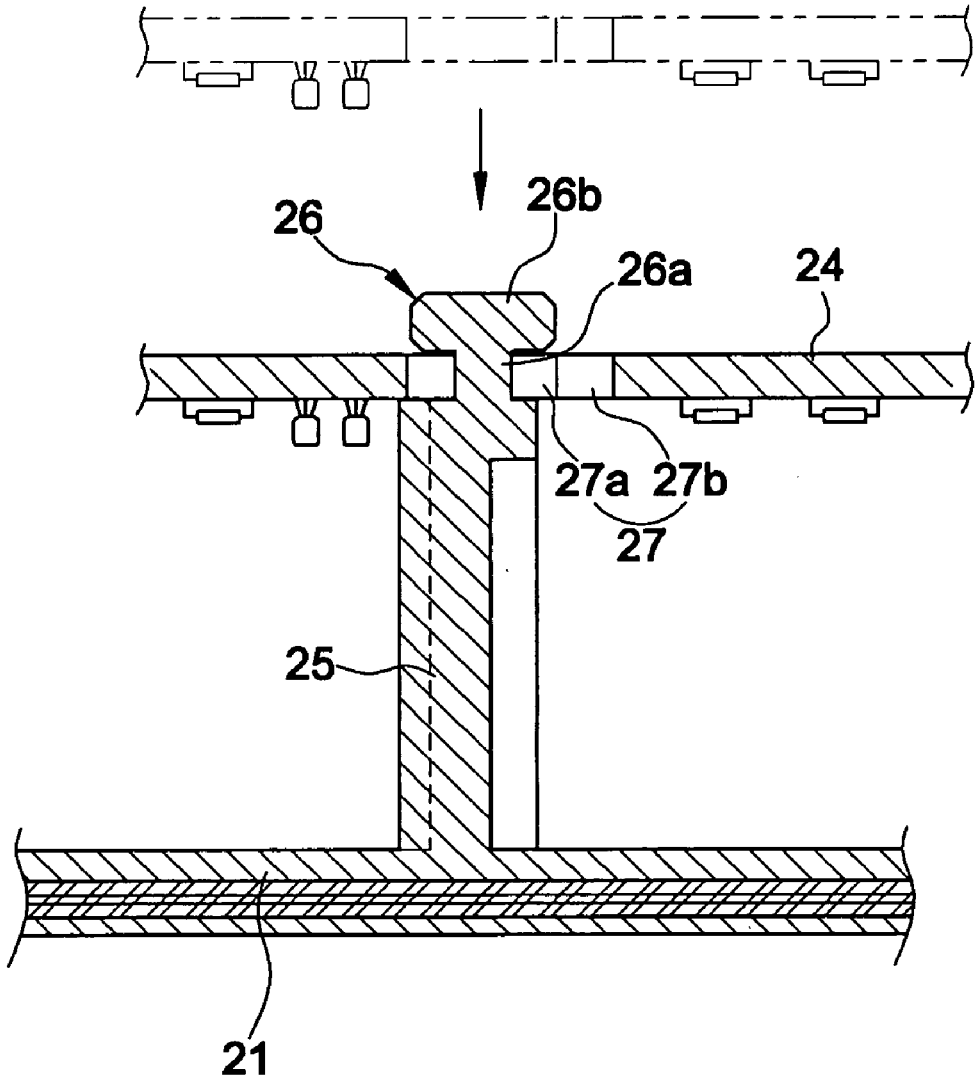
FIG. 4 is a sectional view of a circuit board mounting structure of the control panel in the microwave oven according to the invention, illustrating a state in which engagement protrusions of coupling members are inserted into engagement holes of the circuit board, respectively.
Figure 5:
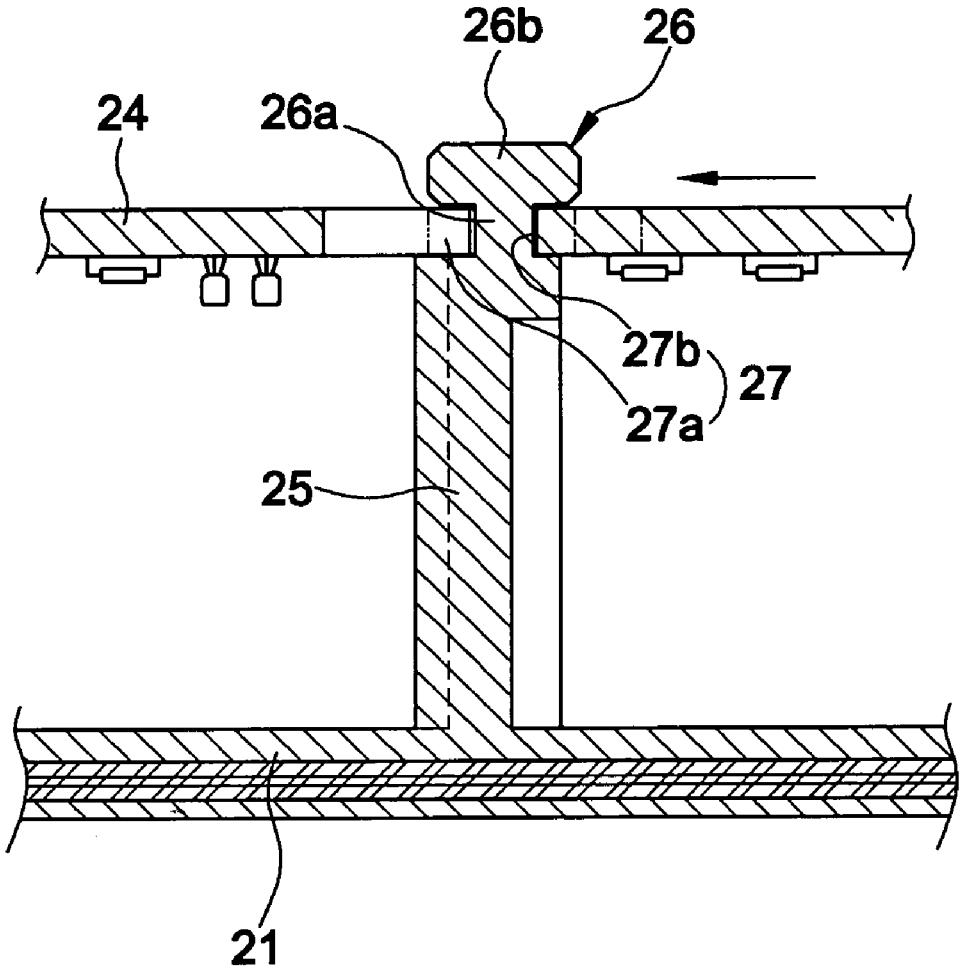
FIG. 5 is a sectional view of the circuit board mounting structure of the control panel, illustrating a state in which the engagement protrusions of the coupling members are engaged with the engagement holes of the circuit board, respectively.
Figure 6:
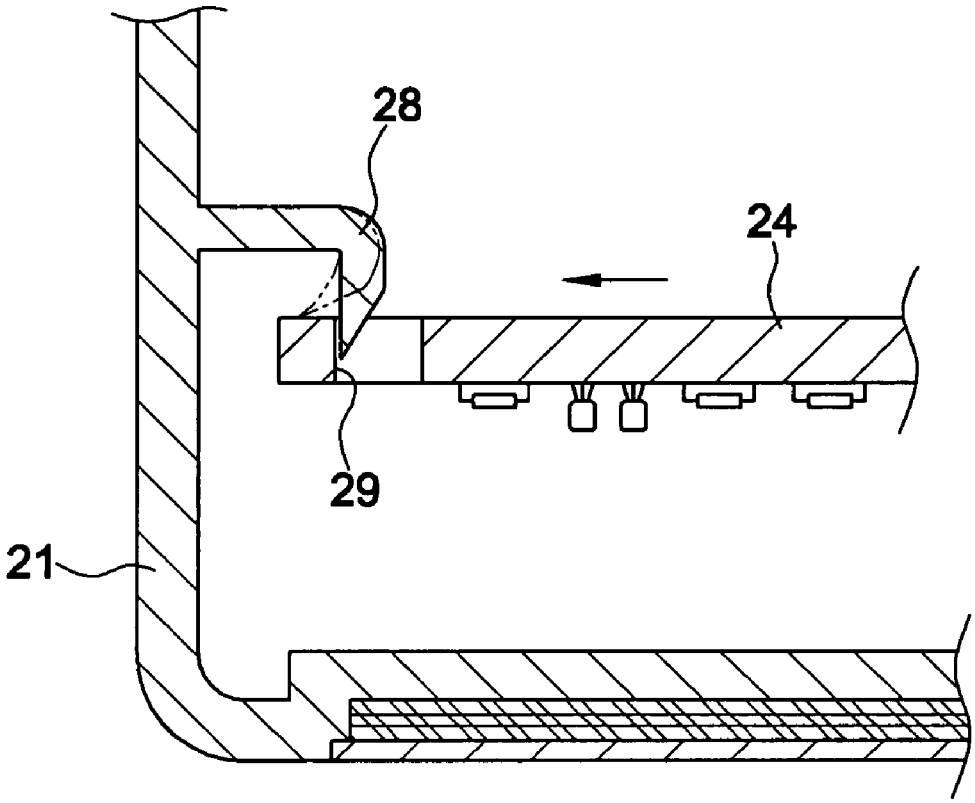
FIG. 6 is a sectional view of the circuit board mounting structure of the control panel, illustrating an engagement structure of locking hooks provided at the case and locking holes provided at the circuit board.

As shown in FIGS. 2 and 4, the engagement protrusion 26 of each coupling member 25 has a neck 26*a* having a narrowed structure to have a cross-sectional area smaller than that of the coupling member 25, and a head 26*b* formed at an end of the neck 26*a* opposite to the coupling member 25 while having an enlarged structure to have a cross-sectional area larger than that of the neck 26*a*. Each engagement hole 27 of the circuit board 24 to be engaged with an associated one of the engagement protrusions 26 has an entrance portion 27*a* having a size allowing the head 26*b* of the associated engagement protrusion 26 to pass therethrough, and an engagement portion 27*b* formed at one side of the entrance portion 27*a* while having a width corresponding to the width of the neck 26*a* of the associated engagement protrusion 26. With these configurations, the engagement between the associated engagement protrusion 26 and engagement hole 27 is achieved, as shown in FIGS. 3, 4, and 5, by inserting the head 26*b* of the engagement protrusion 26 into the entrance portion 27*a* of the engagement hole 27, and then pushing the circuit board 24 in a longitudinal direction thereof to cause the neck 26*a* of the engagement protrusion 26 to be inserted into the engagement portion 27*b* of the engagement hole 27. That is, the head 26*b* of the engagement protrusion 26 is engaged with the engagement portion 27*b* of the engagement hole 27 in accordance with the insertion of the neck 26*a* of the engagement protrusion 26 into the engagement portion 27*b* of the engagement hole 27. In order to achieve such an engagement between the coupling members 25 and the associated engagement holes 27 in a simultaneous manner, the engagement portions 27*b* of the engagement holes 27 should be oriented in the same direction, as shown in FIG. 2.

Although the above described embodiment of the invention illustrates the structure in which the engagement protrusion 26 of each coupling member 25 having the neck 26*a* and head 26*b* is engaged with the associated engagement hole 27 of the circuit board 24, the same purpose as that of the above described embodiment may be obtained, using other structures. For example, a groove having a certain depth may be formed on a portion of one longitudinal surface of each coupling member 25 near the protruded end of the coupling member 25. In this case, the groove of the coupling member 25 may be engaged with one side of the associated engagement hole 27 of the circuit board 24 facing the groove when the coupling member 25 is inserted into the associated engagement hole 27.

The control panel 20 according to the invention also includes a configuration adapted to restrict a vertical movement of the circuit board 24 under the condition in which the mounting of the circuit board 24 has been achieved in accordance with the engagement between the coupling members 25 and the engagement holes 27, thereby preventing separation of the circuit board 24. For this configuration, as shown in FIGS. 2 and 3, the control panel 20 may include locking hooks 28 provided at an inner peripheral surface of the case 21, and locking holes 29 formed through a peripheral portion of the circuit board 24 at positions respectively corresponding to the locking hooks 28.

Each locking hook 28 has a certain elasticity so that it is elastically deformed as it comes into contact with the circuit board 24 when the circuit board 24 is downwardly moved in the mounting process thereof. In accordance with the elastic deformation thereof, the locking hooks can be engaged with the locking hooks 28, respectively, thereby restricting movement of the circuit board 24. Accordingly, the circuit board 24 is firmly held in the interior of the case 21 in accordance with the engagement between the coupling members 25 and the engagement holes 27 while being prevented from moving in a longitudinal direction thereof in accordance with the engagement between the locking hooks 28 and the locking holes 29. Thus, the circuit board 24 can be mounted in the interior of the case 21 without using separate fixing screws, in accordance with a single-pass mounting process.

As is apparent from the above description, in the microwave oven according to the invention, the case and circuit board of the control panel thereof are structured to be coupled with each other in accordance with the engagement between the coupling members and the engagement holes, and the engagement between the locking hooks and the locking holes. Accordingly, it is possible to mount the circuit board to the rear side of the case in the interior of the case without using fixing screws, in accordance with a single-pass mounting process, thereby achieving an enhancement in the productivity of circuit boards and a reduction in manufacturing costs.

Although the exemplary embodiments of the invention have been disclosed for illustrative purposes, the invention is not limited to these embodiments. Those skilled in the art will appreciate that various modifications, additions and substitutions are possible, without departing from the scope and spirit of the invention as disclosed in the accompanying claims.

What is claimed is:

1. A microwave oven control panel comprising a case, a circuit board and a coupling device coupling the case and the circuit board, wherein the coupling device comprises:

a coupling member, protruding from an inner surface of the case, comprising an engagement protrusion at a distal end thereof; and an engagement hole, provided in the circuit board, engaged with the engagement protrusion of the coupling member.

2. The microwave oven control panel according to claim 1, wherein the engagement protrusion comprises a neck having a first cross-sectional area, and a head formed at a distal end of the neck having a second cross-sectional area larger than the first cross sectional area.

3. The microwave oven control panel according to claim 1, wherein the engagement hole comprises: an entrance portion having a first width; and an engagement portion formed at one side of the entrance portion, having a second width smaller than the first width.

4. The microwave oven control panel according to claim 3, wherein the engagement hole comprises an entrance portion having a size allowing the head of the engagement protrusion to pass therethrough, and an engagement portion formed at one side of the entrance portion having a width corresponding to that of the neck of the engagement protrusion to allow the neck to be inserted therein and to be engaged therewith.

5. The microwave oven control panel according to claim 1, wherein the engagement between the engagement protrusion of the coupling member and the engagement hole is achieved in accordance with an insertion of the engagement protrusion into the engagement hole, and a subsequent movement of the circuit board in a direction orthogonal to that of the insertion of the engagement protrusion.

6. The microwave oven control panel according to claim 5, wherein:

the engagement protrusion comprises a neck having a first cross-sectional area, and a head formed at a distal end of the neck having a second cross-sectional area larger than the first cross sectional area; and the engagement hole comprises an entrance portion having a size allowing the head of the engagement protrusion to pass therethrough, and an engagement portion formed at one side of the entrance portion having a width corresponding to that of the neck of the engagement protrusion to allow the neck to be inserted therein and to be engaged therewith.

7. The microwave oven control panel according to claim 5, wherein the coupling device further comprises:

a locking hook protruding from the case; and a locking hole provided in the circuit board to engage with the locking hook, whereby movement of the circuit board in a direction orthogonal to the insertion direction is restricted under a condition in which the coupling member and the engagement hole are in an engaged state.

8. The microwave oven control panel according to claim 7, wherein the locking hook is elastically deformable at a portion engageable with the locking hole.

9. The microwave oven control panel according to claim 7, wherein the one side of the engagement hole where the engagement portion is formed is a side furthest away from the locking hole.

10. The microwave oven control panel according to claim 1, wherein the coupling device prevents movement of the circuit board away from the case in a first direction, and further comprises:

a locking hook protruding from the case; and a locking hole provided in the circuit board to engage with the locking hook, wherein the engagement of the locking hook and locking hole prevents the movement of the circuit board relative to the case in a second direction perpendicular to the first direction.

11. The microwave oven control panel according to claim 10, wherein the locking hook is elastically deformable at a portion engageable with the locking hole.

12. The microwave oven control panel according to claim 5, wherein the engagement protrusion has a groove adapted to be engaged with a portion of the circuit board corresponding to one side of the engagement hole when subsequent movement of the circuit board is carried out.

13. The microwave oven control panel according to claim 1, wherein a plurality of engagement protrusions and engagement holes are provided.

14. The microwave oven control panel according to claim 1, wherein the case is concave and surrounds the perimeter of the circuit board.

15. The microwave oven control panel according to claim 1, wherein the circuit board is planar.

16. The microwave oven control panel according to claim 1, wherein the engagement hole is T-shaped.

17. The microwave oven control panel according to claim 1, wherein the engagement protrusion is T-shaped in cross-section.

18. The microwave oven control panel according to claim 7, wherein the case is concave and the locking hook protrudes inwardly from a peripheral surface of the case.

19. The microwave oven control panel according to claim 10, wherein the case is concave and the locking hook protrudes inwardly from a peripheral surface of the case.

* * * * *